US010910688B2

(12) United States Patent
Chen et al.

(10) Patent No.: US 10,910,688 B2
(45) Date of Patent: Feb. 2, 2021

(54) DIELECTRIC PHASE SHIFTING UNIT, DIELECTRIC PHASE SHIFTER AND BASE STATION ANTENNA

(71) Applicant: Comba Telecom Technology (Guangzhou) Limited, Guangdong (CN)

(72) Inventors: Litao Chen, Guangdong (CN); Bin Gao, Guangdong (CN); Peitao Liu, Guangdong (CN); Guosheng Su, Guangdong (CN)

(73) Assignee: Comba Telecom Technology (Guangzhou) Limited

( * ) Notice: Subject to any disclaimer, the term of this patent is extended or adjusted under 35 U.S.C. 154(b) by 0 days.

(21) Appl. No.: 16/462,652

(22) PCT Filed: May 19, 2017

(86) PCT No.: PCT/CN2017/085005

§ 371 (c)(1),
(2) Date: May 21, 2019

(87) PCT Pub. No.: WO2018/094983

PCT Pub. Date: May 31, 2018

(65) Prior Publication Data

US 2020/0067159 A1 Feb. 27, 2020

(30) Foreign Application Priority Data

Nov. 25, 2016 (CN) ..... 2016 1 1063025

(51) Int. Cl.
*H01P 1/18* (2006.01)

(52) U.S. Cl.
CPC ..... *H01P 1/182* (2013.01)

(58) Field of Classification Search
CPC . H01P 1/182; H01P 1/184; H01P 1/18; H01Q 3/32; H01Q 1/50; H01Q 3/36
(Continued)

(56) References Cited

U.S. PATENT DOCUMENTS 5,905,462 A 5/1999 Hampel et al.
2018/0115297 A1* 4/2018 Yoshihara ..... H01Q 3/32

FOREIGN PATENT DOCUMENTS

CN 1669175 A 9/2005
CN 104681896 A 6/2015
(Continued)

OTHER PUBLICATIONS

International Search Report PCT/CN2017/085005, dated Aug. 16, 2017.

*Primary Examiner* — Robert J Pascal
*Assistant Examiner* — Kimberly E Glenn
(74) *Attorney, Agent, or Firm* — Lerner, David, Littenberg, Krumholz & Mentlik, LLP

(57) ABSTRACT

The present invention relates to the field of communications technology, and in particular, to technology related to impedance matching in communication technology, and in particular, to a dielectric phase shifting unit, dielectric phase shifter and base station antenna. It includes a feeding network and a dielectric plate for impedance matching and for moving along a predetermined path, an impedance matching portion of the dielectric plate being disposed on one end of the dielectric plate adjacent to an input port on the feeding network. The present invention not only reduces the number of impedance matching and network loss; it also reduces the equivalent electrical length of the entire network, effectively saving costs, reducing the complexity of disassembly and assembly of related components, and improves disassembly and assembly efficiency.

9 Claims, 2 Drawing Sheets

(58) Field of Classification Search
USPC ..... 333/33
See application file for complete search history.

(56) References Cited

FOREIGN PATENT DOCUMENTS

| | | | | | |
|---|---|---|---|---|---|
| CN | 105244568 | A | | 1/2016 | |
| CN | 105720329 | A | | 6/2016 | |
| CN | 106129544 | A | | 11/2016 | |
| CN | 106450763 | A | | 2/2017 | |
| WO | WO-2016157374 | A1 | * | 10/2016 | ..... H01P 1/18 |

* cited by examiner

DIELECTRIC PHASE SHIFTING UNIT, DIELECTRIC PHASE SHIFTER AND BASE STATION ANTENNA

CROSS-REFERENCE TO RELATED APPLICATIONS

The present application is a national phase entry under 35 U.S.C § 371 of International Application No. PCT/CN2017/085005 filed May 19, 2017, which claims priority from Chinese Application No. 201611063025.1 filed Nov. 25, 2016, all of which are hereby incorporated herein by reference.

FIELD OF THE INVENTION

The present invention relates to the field of communications technology, and in particular, to technology related to impedance matching in communication technology, and in particular, to a dielectric phase shifting unit, dielectric phase shifter and base station antenna.

BACKGROUND OF THE INVENTION

In the coverage of mobile communication network, a base station antenna is one of key devices for network coverage, and a phase shifter is a core component of the electric adjustable base station antenna. The performance of the phase shifter directly determines the performance of the electric adjustable base station antenna, which in turn affects the coverage quality of the network. Therefore, the importance of the phase shifter in the field of mobile base station antenna is self-evident.

A prior art phase shifter mainly relies on adjusting the phase from an input port to an output port by moving the dielectric in a cavity, thereby changing the phase input to an antenna array, thereby adjusting the beam down-tilt angle of the base station antenna. Here, the technology related to impedance matching in the dielectric phase shifter has a relatively great impact on the performance of various aspects of the phase shifter.

Referring to FIG. 1, in the prior art phase shifter, impedance matching portions (3*a*, 4*a*) on a dielectric plate 6*a* are disposed on the dielectric plate 6*a* at one end away from an input port 2*a* of a feeding network. The dielectric plate 6*a* covers branch intersections in the feeding network. This type of phase shifter has at least the following defects: 1. in operation, since the impedance of the signal output port (1*a*, 5*a*) must be the same as the line impedance covered by the dielectric plate 6*a*, it is necessary to perform 2 to 3 times discontinuous impedance matching; this not only increases the impedance change nodes but also causes greater impedance mismatch and larger return loss; 2. at the nodes of the power divider, the impedance is small because it is covered by the dielectric plate 6*a*, and when working, it is necessary to increase the impedance before connecting them in parallel, otherwise, the line size will need to be increased due to the line impedance being too small, which would make the components difficult to install; and 3. because the impedance changes frequently during operation, and the means of changing the impedance have certain bandwidth limitation, it would inevitably lead to poor impedance matching characteristics; due to the poor matching characteristics, the output signal of the power splitter would have obvious nonlinearity at different frequencies, and the consistency would be relatively poor.

Therefore, prior art dielectric phase shifter structure obviously has the above inconveniences and drawbacks in actual use, and it is necessary to adjust the impedance matching manner in the dielectric phase shifter.

SUMMARY OF THE INVENTION

The object of the present invention is to solve at least one of the above problems, and to provide a dielectric phase shifting unit, dielectric phase shifter and base station antenna.

To achieve the object, the present invention provides a dielectric phase shifting unit including a feeding network and a dielectric plate for impedance matching and for moving along a predetermined path. An impedance matching portion of the dielectric plate is disposed on one end of the dielectric plate adjacent to an input port on the feeding network.

Optionally, the impedance matching portion includes at least one matching hole.

Optionally, the dielectric plate further includes an extension portion integrally formed with the impedance matching portion; the impedance matching portion having a thickness smaller than that of the extension portion.

Further, the feeding network further includes at least one output port.

Correspondingly, the present invention further provides a dielectric phase shifter, including: a cavity, a dielectric phase shifting unit according to any one of the above implementations, wherein the dielectric plate is disposed between the cavity and the feeding network.

Optionally, there is a plurality of the dielectric phase shifting units, and they are sequentially connected in series to form at least one series group or connected side by side.

Further, every two adjacent dielectric phase shifting units in the series group are misaligned in a shape of a "Z" or an inverse "Z" such that the dielectric plate does not alternatively cover the feeding network when moving.

Optionally, there is a plurality of the series groups, and the series groups are arranged side by side.

Preferably, when the dielectric phase shifting units in the series group are connected in series, the corresponding dielectric plates are integrally connected and the feeding networks are also integrally connected.

Further, the dielectric plate and feeding network form a strip line structure.

Correspondingly, the present invention also provides a base station antenna, including a dielectric phase shifter according to any one of the above technical solutions.

Compared with the prior art, the present invention has the following advantages:

In the dielectric phase shifting unit of the present invention, as the impedance matching portion on the dielectric plate is disposed on one end of the dielectric plate adjacent to the input port on the feeding network, in the phase shifting process, the relevant line segment only needs to perform one discontinuous impedance matching, which not only reduces the impedance change nodes but also reduces impedance mismatch and return loss, which in turn helps to integrate the feeding network in the phase shifter. Of course, the dielectric phase shifting unit can also be applied to the dielectric phase shifter of the present invention to bring these advantages.

In addition, in the dielectric phase shifter of the present invention, there is a plurality of dielectric phase shifting units, and the dielectric phase shifting units are sequentially connected in series to form at least one series group or in parallel; and because a single dielectric phase shifting unit needs only one impedance matching, and therefore, compared with the prior art, it reduces the number of impedance matching and network loss. Moreover, when a plurality of dielectric phase shifting units are sequentially connected in series or in parallel and disposed in the dielectric phase shifter, the electrical length and network loss of the entire network can be greatly reduced, thereby effectively saving cost and improving performance of the phase shifter. At the same time, because the feeding network within the structure of the dielectric phase shifting unit is simple, and because when the dielectric phrase shifting unit is applied to the dielectric phase shifter in the present invention, the installation complexity of related components can be reduced in order to save the limited space of the cavity, and it is convenient to install as many dielectric phase shifting units as possible in the limited space of the cavity, thereby help improve the shape of the antenna.

Correspondingly, every two adjacent dielectric phase shifting units in the series group are misaligned in a shape of a "Z" or an inverse "Z" such that the dielectric plate does not alternatively cover the feeding network when moving. This setting ensures an equal phase relationship among the output ports, thereby realizing the shaping and electric adjustability of the antenna.

Furthermore, when the dielectric phase shifting units in the series group are connected in series, the corresponding dielectric plates are integrally connected and the feeding networks are also integrally connected. This reduces the complexity of disassembly and assembly of the dielectric phase shifting units, improving efficiency in disassembly and assembly; it also effectively ensures the impedance matching and stability of the relevant performance of the dielectric phase shifter.

In summary, the present invention not only reduces the number of impedance matching and network loss but also the equivalent electrical length of the entire network, effectively saving costs, reducing the complexity of disassembly and assembly of related components, and improving disassembly and assembly efficiency. Moreover, it is convenient to install as many dielectric phase shifting units as possible in a limited space in the cavity and to ensure an equal phase relationship between the output ports, thereby improving the performances of the dielectric phase shifter and the electric adjustable base station antenna.

DETAILED DESCRIPTION OF THE INVENTION

Figure 1:
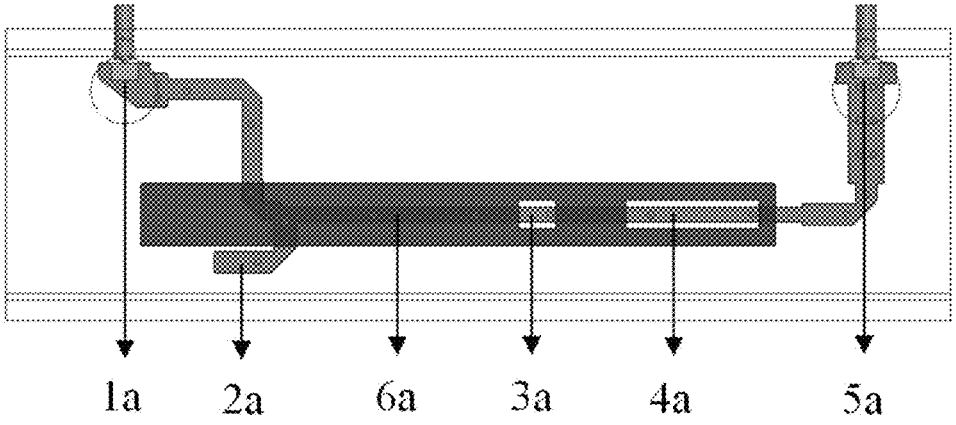
FIG. 1 is a schematic structural view of a dielectric phase shifting unit in the prior art.

The invention is further described in the following with reference to the drawings and exemplary embodiments; wherein like reference numerals refer to the same parts throughout. Further, if a detailed description of a known technique is unnecessary for showing the features of the present invention, it is omitted.

Figure 2:
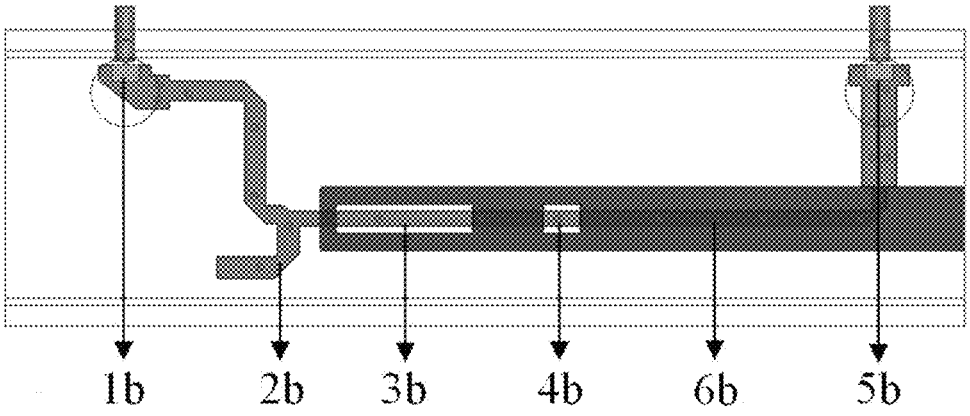
FIG. 2 is a schematic structural view of an exemplary embodiment of a dielectric phase shifting unit of the present invention.

Reference is made to FIG. 2. In a schematic structural view of an exemplary embodiment of a dielectric phase shifting unit of the present invention, a dielectric phase shifting unit including a feeding network and a dielectric plate 6*b* for impedance matching and for moving along a predetermined path. An impedance matching portion of the dielectric plate is disposed on one end of the dielectric plate adjacent to an input port 2*b* on the feeding network.

It should be noted that the dielectric plate 6*b* further includes an extension portion integrally formed with the impedance matching portion. The feeding network further includes at least one output port, and preferably, the feeding network includes two output ports (1*b*, 5*b*). The two output ports (1*b*, 5*b*) form a 2 way phase shifting network through a power divider on the feeding network. One of the output ports 1*b* is disposed near one end of the input port 2*b* and its branch network is not covered by the dielectric board 6*b*. Another output port 5*b* is provided at one end away from the input port 2*b* and its branch network is covered by the dielectric plate 6*b* to achieve a continuous change in phase by moving the dielectric plate 6*b* to adjust the length covering its branch network.

In this embodiment, the impedance matching portion includes at least one matching hole. Alternatively, the impedance matching portion may have a smaller thickness than the extension portion in place of the matching hole in order to implement an impedance matching function, and the specific number of the matching holes or the thickness of the impedance matching portion may be determined according to the width of the frequency band; and preferably, the impedance matching portion includes two matching holes (3*b*, 4*b*).

During operation of the dielectric phase shifting unit, when the down-tilt angle is increased, the dielectric plate 6*b* is controlled to move away from the input port 2*b*. At this time, the branch network where the output port 1*b* near one end of the input port 2*b* is located and a matching hole area are not covered by the dielectric board 6*b*. Because the impedance matching portion is at an end close to the input port 2*b*, the impedance of the output port 5*b* far away from the input port 2*b* is the same as that of the network line segment covered by the dielectric plate 6*b*. There is no need to perform impedance transformation. It can be seen that when the signal is transmitted from the input port 2*b* to the output port 5*b* away from the input port 2*b*, only one discontinuous impedance matching is required. Compared with the prior art, which requires 2-3 times, the dielectric phase shifting unit of present invention can not only reduce impedance change nodes, but also reduce impedance mismatch and return loss.

Applying the dielectric phase shifting unit described in the above embodiments to the dielectric phase shifter, thereby further fully applying the characteristics of the dielectric phase shifting unit to the dielectric phase shifter. Here, the dielectric phase shifter includes a cavity and the dielectric phase shifting unit disposed therein; the dielectric plate is disposed between the cavity and the feeding network.

Figure 3:
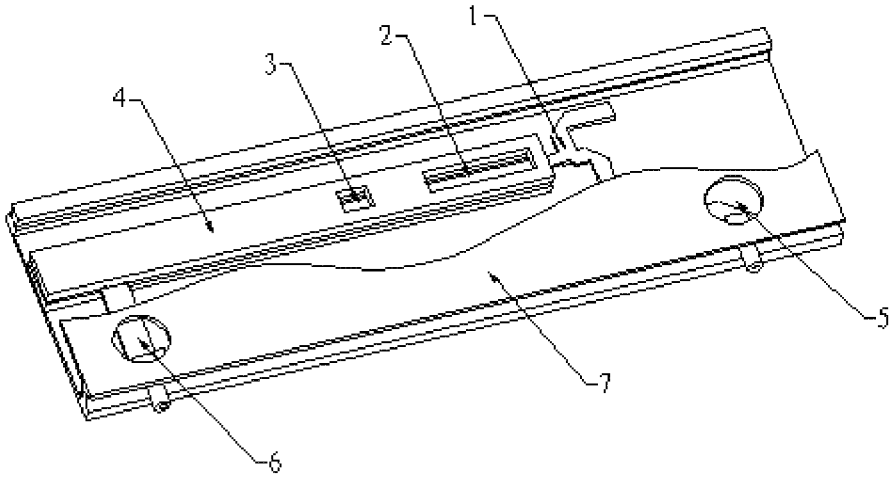
FIG. 3 is a schematic structural view of an exemplary embodiment of a dielectric phase shifting unit of the present invention.

Please refer to FIG. 3, which shows a schematic structural view of an exemplary embodiment of a phase shifting dielectric of the present invention. The feeding network in the dielectric phase shifter forms a 2 way phase shift network line through the power divider in the feeding network. The dielectric plate 4 and the feeding network form a strip line structure, and the entire strip line structure is located in the metal cavity 7.

Here, the feeding network includes an input port 1, a first output port 5 disposed near the input port 1, and a second output port 6 disposed away from the input port 1. A dielectric plate 4 includes a large matching hole 2 and a small matching hole 3. In addition, signal input and output can be achieved by soldering a coaxial cable to an inner core of the corresponding input and output ports on the feeding network.

As can be seen from FIG. 3, the input impedance of the second output port 6 is the same as that of a circuit segment covered by the dielectric plate 4. No impedance transformation is required between the second output port 6 and the circuit segment covered by the dielectric plate 4. Rather, the circuit segment not covered by the dielectric plate 4 is different in the line width from the circuit segment covered by the dielectric plate 4 to achieve the same impedance. The signal is adjusted by adjusting the impedance of the large matching hole 2 and the small matching hole 3 on the dielectric plate 4; increasing the impedance so that the impedance thereof is the same as that of the circuit segment not covered by the dielectric plate 4, thereby reducing the return loss. Meanwhile, in the process, the phase between the output port 1 and the second output port 6 is adjusted by adjusting the length of the circuit segment covered by the dielectric plate 4. The impedance becomes larger after passing through the matching holes, so that the impedance after being connected in parallel with the first output port 5 is also increased. Therefore, it helps to reduce the circuit width of the power divider on the feeding network, and it avoids the circuit layout being difficult due to overly small impedance, or the signal being severely coupled due to the distance between the circuits being too small.

On the basis of the dielectric phase shifter described in the above embodiments, a plurality of dielectric phase shifting units can be disposed in the cavity. Specifically, each dielectric phase shifting unit may be connected in series to form at least one series group or in parallel to define a N way (N>3) phase shifting network circuit. Here, when the respective dielectric phase shifting units in the series group are connected in series, the corresponding dielectric plates and the feeding network can be integrally connected.

Figure 4:
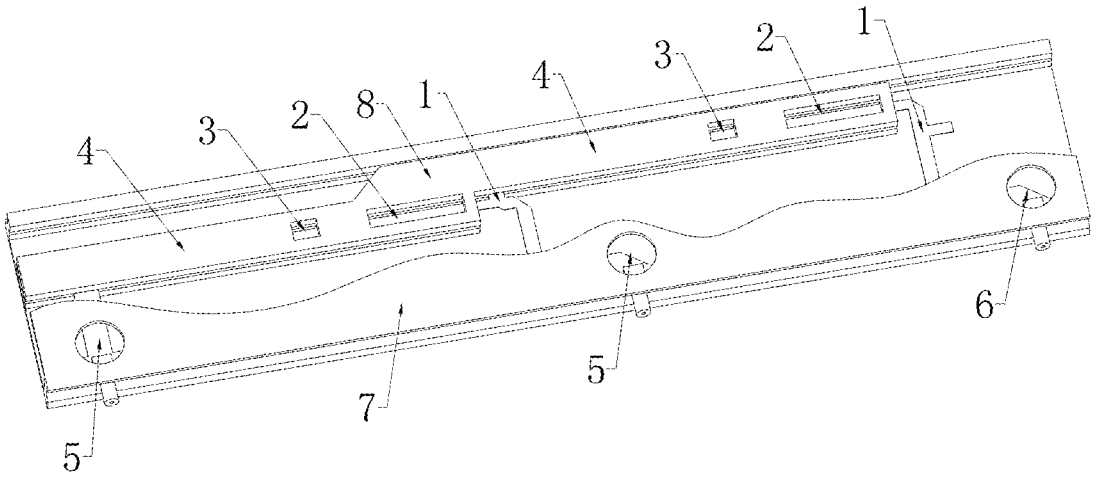
FIG. 4 is a schematic structural view of another embodiment of a dielectric phase shifter of the present invention, wherein two dielectric phase shifting units are connected in series to form a series group.

For example, please refer to FIG. 4, which shows a schematic structural view of another embodiment of a dielectric phase shifter in the present invention. In this embodiment, the two dielectric phase shifting units described in the above embodiments are connected in series to form one series group, and then the series group is installed in the cavity 7, which forms a 3 way phase shifting network line.

The dielectric phase shifter connects the dielectric plates 4 of the two dielectric phase shifting units together by means of a connection portion 8. The two dielectric phase shifting units are connected end to end. The impedance matching portion (the large matching hole 2 and the small matching hole 3 on a rear dielectric phase shifting unit) in a rear (based on the distance from input port 1 on the right side of FIG. 4) dielectric phase shifting unit is located at one end close to the connection portion 8. Every two adjacent dielectric phase shifting units in the series group are misaligned in a shape of a "Z" or an inverse "Z" such that the dielectric plate does not alternatively cover the feeding network when moving. In addition, the difference between this embodiment and the foregoing embodiment is that the feeding network in this embodiment includes three output ports, that is, a proximal output port 6 disposed adjacent to the input port 1 and two distal output ports 5 away from the input port 1. When the dielectric plate 4 moves, only one discontinuous impedance matching is required between the two distal output ports 5 and between the proximal output port 6 and a middle distal output port 5, so that a phase difference relationship can be defined, thus helping to achieve the shaping and electronic adjustment of the antenna.

Correspondingly, the above is only an exemplary illustration. According to the actual needs, M (M>2) dielectric phase shifting units may be sequentially connected in series to form one series group which is disposed in the cavity. Alternatively, a plurality of dielectric phase shifting units is disposed side by side in the cavity, or a plurality of series groups is disposed side by side in the cavity. Every two adjacent dielectric phase shifting units in each series group are misaligned in a shape of a "Z" or an inverse "Z" such that the dielectric plate does not alternatively cover the feeding network when moving, and the space inside the cavity is fully utilized.

In summary, the dielectric phase shifter of the present invention can not only have all the features of the dielectric phase shifting unit in the above embodiments, it can also fully utilize the characteristics of the dielectric phase shifting unit. That is to say, because the single phase shifting unit only needs to perform impedance matching once, the number of impedance matching and the network loss are reduced as compared with the prior art. When a plurality of dielectric phase shifting units is sequentially connected in series to form a series group or in parallel and disposed in a dielectric phase shifter, the equivalent electrical length and network loss of the entire network can be significantly reduced, thereby effectively saving cost and ensuring impedance matching, thereby improving performance of the phase shifter. Also, the structure of the feeding network of the dielectric phase shifting unit is simple, the dielectric plate and the feeding network form together a strip line structure, and the plurality of dielectric phase shifting units can be installed in the cavity after integrally formed. These factors reduce the complexity of disassembly and assembly of related components, improves disassembly efficiency, saves limited space in the cavity, and facilitates installation of as many dielectric phase shifting units as possible in a limited space in the cavity, thereby further improving the performance of the phase shifter.

In addition, the dielectric phase shifter of the above embodiments is applied to the base station antenna, thereby further utilizing the characteristics of the dielectric phase shifter in the base station antenna, which not only reduces network loss in the base station antenna, but also effectively ensures impedance matching, stability of the performance of the base station antenna, and installs as many dielectric phase shifting units as possible in a limited space in the cavity, thereby improving the shape of the base station antenna.

Although some exemplary embodiments of the invention have been shown above, those skilled in the art will understand that variations may be made to these exemplary embodiments without departing from the spirit and scope of the invention, and the scope of the invention is defined by the claims and their equivalents.

The invention claimed is:

1. A dielectric phase shifting unit, comprising a feeding network and a dielectric plate for impedance matching and for moving along a predetermined path, an impedance matching portion of the dielectric plate being disposed on one end of the dielectric plate adjacent to an input port on the feeding network, wherein the dielectric plate further includes an extension portion integrally formed with the impedance matching portion, the impedance matching portion having a thickness smaller than that of the extension portion.

2. The dielectric phase shifting unit as recited in claim 1, wherein the impedance matching portion includes at least one matching hole.

3. The dielectric phase shifting unit as recited in claim 1, wherein the feeding network further includes at least one output port.

4. A dielectric phase shifter, comprising: a cavity, a dielectric phase shifting unit according to claim 1, wherein the dielectric plate is disposed between the cavity and the feeding network, wherein there is a plurality of the dielectric phase shifting units, and the dielectric phrase shifting units are sequentially connected in series to form at least one series group or they are connected side by side, and every two adjacent dielectric phase shifting units in the series group are misaligned in a shape of a "Z" or an inverse "Z" such that the dielectric plate does not alternatively cover the feeding network when moving.

5. The dielectric phase shifter as recited in claim 4, wherein there is a plurality of the series groups, and the series groups are arranged side by side.

6. The dielectric phase shifter as recited in claim 4, wherein when the dielectric phase shifting units in each series groups are connected in series, the corresponding dielectric plates are integrally connected and the feeding networks are also integrally connected.

7. A base station antenna, comprising a dielectric phase shifter according to claim 4.

8. The dielectric phase shifter as recited in claim 4, wherein when the dielectric phase shifting units in each series groups are connected in series, the corresponding dielectric plates are integrally connected and the feeding networks are also integrally connected.

9. The dielectric phase shifter as recited in claim 5, wherein when the dielectric phase shifting units in each series groups are connected in series, the corresponding dielectric plates are integrally connected and the feeding networks are also integrally connected.

* * * * *